United States Patent [19]

Sherwood

[11] 3,997,231

[45] Dec. 14, 1976

[54] TEST CONNECTOR

[75] Inventor: Theodore R. Sherwood, Sunnyvale, Calif.

[73] Assignee: The United States of America as represented by the Secretary of the Navy, Washington, D.C.

[22] Filed: Dec. 8, 1975

[21] Appl. No.: 638,885

[52] U.S. Cl. ..... 339/75 M; 339/176 MP

[51] Int. Cl.[2] ..... H01R 13/54

[58] Field of Search ..... 339/17 L, 17 LC, 75 MP, 339/75 M, 75 R, 176 MP

[56] References Cited

UNITED STATES PATENTS 3,924,916 12/1975 Venaleck ..... 339/17 LC

FOREIGN PATENTS OR APPLICATIONS 1,125,990 3/1962 Germany ..... 339/176 MP 1,395,734 5/1975 United Kingdom ..... 339/75 MP

OTHER PUBLICATIONS

Twin-Contact Connector, IBM Technical Disclosure Bulletin, vol. 14, no. 9, 2–1972, Colletti et al.

*Primary Examiner*—Roy Lake
*Assistant Examiner*—E. F. Desmond
*Attorney, Agent, or Firm*—R. S. Sciascia; Charles D. B. Curry; Elliott N. Kramsky

[57] ABSTRACT

A compact test connector having a slim design to permit side to side installation on a master interconnect board, allowing simultaneous testing of multiple modules. A contact board contains redundant contact surfaces. A simple and compact camming device acts in conjunction with the contact board to impart zero device insertion force and simplified replacement of the most degradable components.

7 Claims, 4 Drawing Figures

TEST CONNECTOR

BACKGROUND OF THE INVENTION

1. Field of the Invention

The present invention relates to electrical test connectors. More particularly, it relates to easily repairable test connectors of compressible design which exert zero insertion force on the contacts of devices to be tested.

2. Description of the Prior Art

Low insertion force electrical connectors have been necessitated by the increased miniaturization of electronic devices and their attendant delicacy. Often a camming device has been the means employed to achieve zero insertion force. See, for instance, Sitzler, U.S. Pat. No. 3,744,005 and Wycheck, U.S. Pat. No. 3,426,313. Prior art devices have mainly dealt with solving the problems caused by direct insertion of the edge of a printed circuit board into a connector to join it electrically to another device and have not dealt extensively with miniaturized electronic devices having elongated contacts. Miniaturization has been limited in many camming devices which utilize a knob control. Such control may only be reduced to a limited extent and remain manually operable.

When one deals with the elongated leads of a miniaturized device, even finer control of insertion force is required than for coupling the edge of a miniaturized board. At all times, however, a reliable electrical connection must be assured between the devices to be coupled. Prior art teachings are generally not adaptable to the special problems involved in coupling miniaturized devices having small elongated contacts and do not recognize the further problems attendant in design of a connector to interface with test equipment or consoles. Such equipment is intended to repeatedly test different devices and must allow for insertion an removal with minimal degradation of contact areas, the portion of any electrical connector most prone to wear out.

The present invention solves these and other related problems by providing a small cam actuated zero insertion force electrical test connector. The cam is designed to be activated by manipulation of its major dimension, thus allowing maximum potential miniaturization. A removable and easily replaceable card having redundant electrical contact surfaces assures simple maintenance and maximum contact area.

SUMMARY OF THE INVENTION

Briefly, the present invention relates to a compact test connector having a slim design to permit side to side installation on a master interconnect board. A contact board contains redundant contact surfaces. A simple and compact camming device acts in conjunction with the contact board to provide zero insertion force and simplified replacement of the most degradable components. The board is contained within a matched pair of camming blocks which vary the distance between the contact parts upon activation caused by moving sliding exterior surfaces. Cone-shaped apertures permit positioning of elongated electrical contacts in the variable space.

Objects of the Invention

An object of the present invention is to provide a zero insertion force electrical connector.

Another object of this invention is to provide an electrical connector especially adapted to achieve the above object and remain operable through repeated insertions and removals of electrical devices.

Yet another object of this invention is to achieve the above objects with a device which provides maximum contact area.

A further object of this invention is to achieve the above objects by means of a design which allows for further simplified miniaturization of the invention.

A still further object of this invention is to achieve the above objects in an electrical connector especially adapted to accommodate an electrical device having elongated contacts.

Futher objects, advantages and novel features of the invention will become apparent from the following detailed description of the invention when considered in conjunction with the accompanying drawings wherein:

DESCRIPTION OF THE PREFERRED EMBODIMENT

Figure 1:
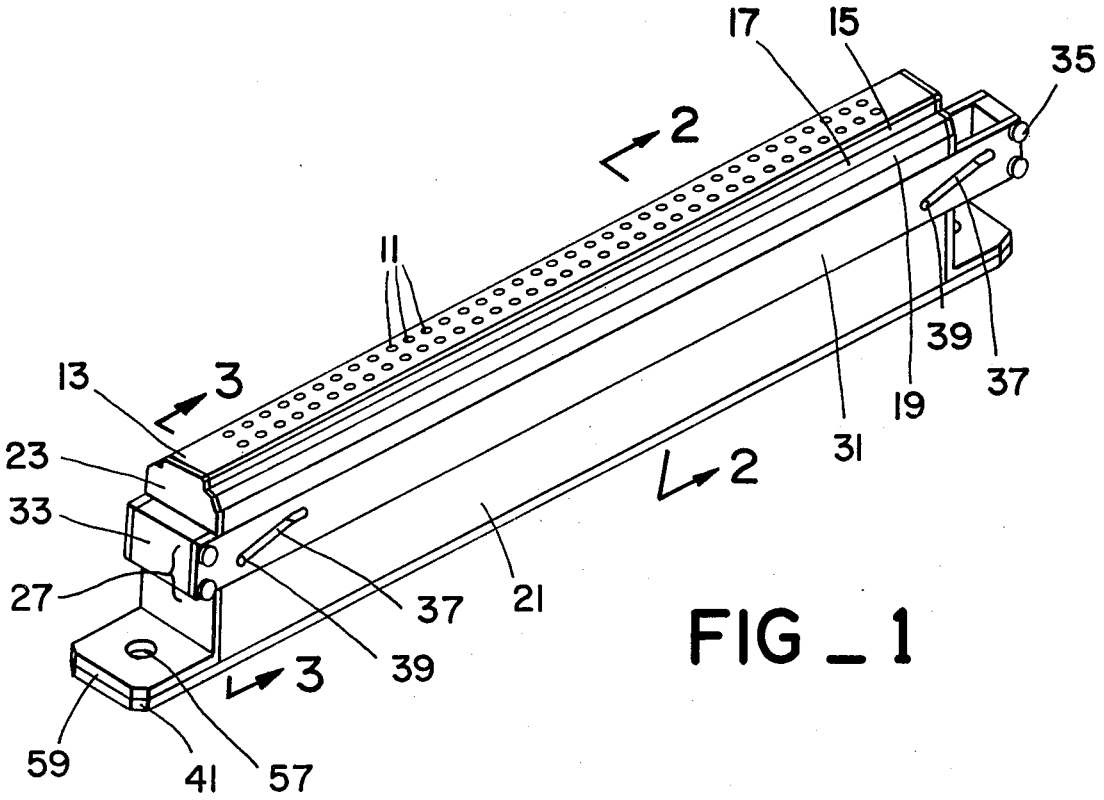
FIG. 1 is a perspective view of the test connector of the present invention.
Figure 2:
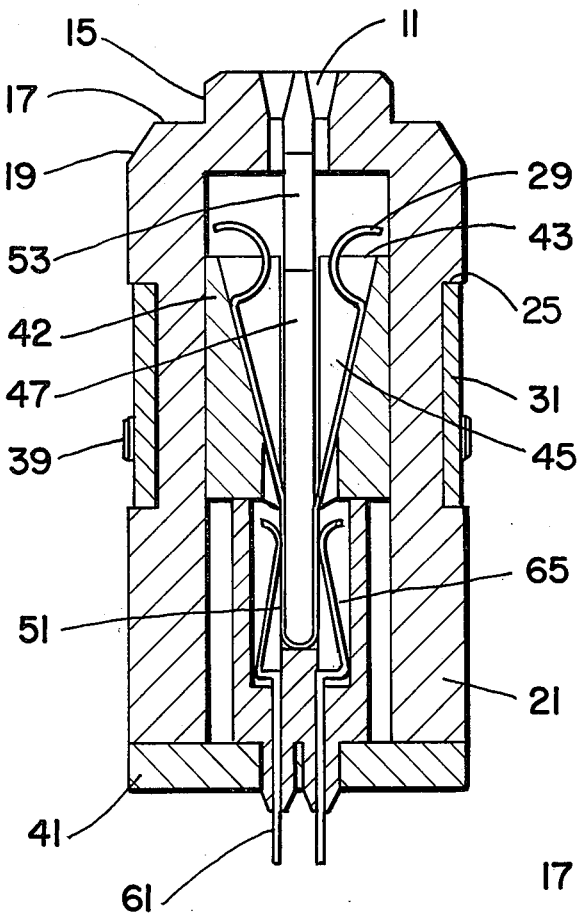
FIG. 2 is a vertical sectional view of the present invention taken along line 2—2 of FIG. 1.

With reference to FIG. 1, there is shown in perspective an embodiment of the present invention. A plurality of contact receptacles 11 are arrayed upon device interface 13. The receptacles are adapted to receive elongated contacts from an electronic device and are arrayed to accommodate a multiplicity of such contacts. It is seen in FIG. 2 that the receptacles 11 may be funnel shaped as a further precaution against insertion force deformations. One hundred contact receptacles 11 are shown in the embodiment illustrated, although such number is not intended as a limiting aspect of the present invention. The size of the receptacles 11 will vary according to the transverse size of the elongated contacts to be inserted and are designed to accord a loose, zero insertion force, fit for such contacts. The present inventive concept is not limited to accommodate only electrical devices having elongated contacts but is also adaptable to electrical devices having one or more contact areas coincident with a circuit board edge or other surface, for example.

An upper portion casing is formed of the device interface 13 and paired ridge panels 15, plateau panels 17, angled panels 19 and side panels 21 which are joined and culminate in a pair of end pieces 23. An abrupt constriction 25 is grooved the length of side panels 21 as shown in FIGS. 2 and 3 which shall be further discussed hereinafter.

A cam activator 27 for adjusting a plurality of spring contacts 29 (shown in FIGS. 2, 3 and 4) to either an open or closed position is shown in FIG. 1 to consist of a pair of locking bar sides 31 joined to a pair of end pieces 33 by plurality of standard fastening means 35. The abrupt constrictions 25 matching side panels 21 permit a slidable engagement between the cam activator 27 and side panels 21.

A pair of inclined slots 37 exists in each locking bar side 31. A rod 39 is associated with each slot 37, each rod spanning the internal width of the test connector. The rods 39 and inclined slots 37 are so arranged that the axes of the rods 39 describe a horizontal plane at all times. The height of each rod relative to anchor plane 41 is determined by the rod's relative position in its inclined slot which, in turn, is determined by the position of the cam activator 17 relative to the side panels 21.

Figure 4:
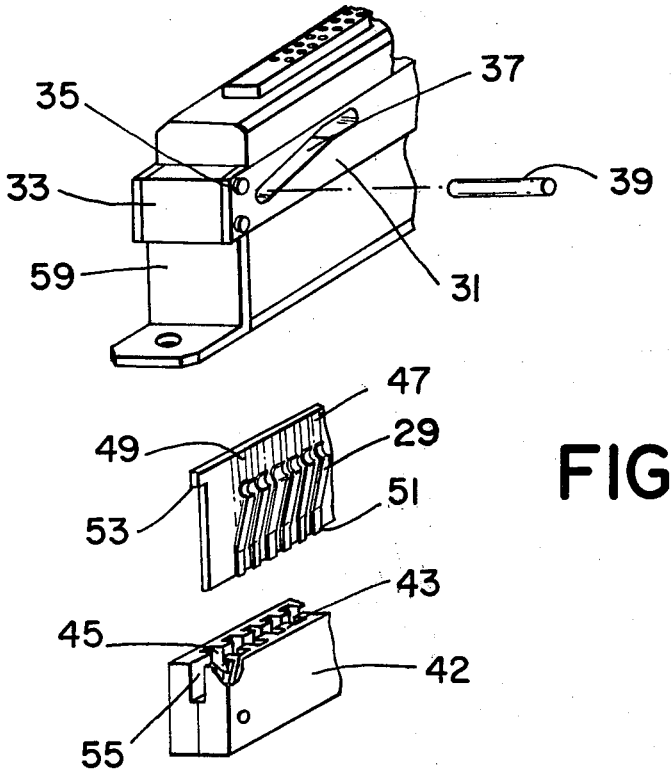
FIG. 4 is an exploded partial perspective view of the present invention.
Figure 3:
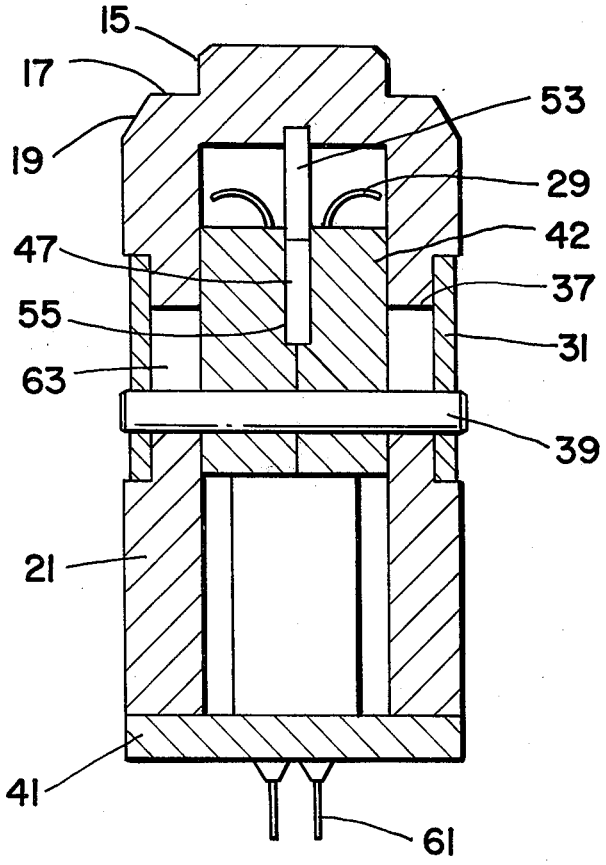
FIG. 3 is a vertical sectional view of the present invention taken along line 3—3 of FIG. 1.

FIG. 3 illustrates a cross section of the invention taken along line 3—3 of FIG. 1. It is seen that rod 39 sits in a notch formed in paired camming blocks 42. FIG. 2, a cross section of the invention taken along line 2—2 of FIG. 1, shows that, between comb-like intervening camming block ridges 43 there exist, alternating with such ridges, a plurality of recesses 45 each having an inclined side. FIG. 4 shows the paired camming blocks 42 in perspective and illustrates their relationship to replaceable contact board 47.

Contact board 47 is constructed of a non-conductive material. On each side of the board exist alternating plane contacts 49. The contacts 49 consist of strips of a conducting material and may be so arranged that, as illustrated in FIG. 2, a strip is located along the projection of receptacle 11. With each plane contact 49 there is paired a spring contact 29 made of a resilient conducting material. Each spring contact 29 and plane contact 49 are joined by standard means such as soldering at a flat junction 51.

contact board 47 has a lip 53 at each end. Each lip 53 sits in a notch 55 formed at the junction of the paired blocks 42. The height of the lips 53 in conjunction with the depth of notch 55 determines the maximum depth at which contact board 47 may be seated within camming blocks 42.

In operation with an electronic device of the type having at least one elongated contact the contact is plugged manually into device interface 13. Anchor plane 41 serves as the base of the present invention and adjoins a second electronic device. A pair of holes 57 provide points of attachment of the invention to the other electrical device, such as a test console. The holes extend through anchor plane 41 and through a pair of shoulders 59 which serve as end portions for the portion of the chamber formed side panels 21 below the cam activator 27. An electrical connection is made between the second device and the contact pins 61 located at the bottom of the anchor plane 41 by any of variety of methods well recognized in the art, such as wire winding. The locking bar sides 31 are moved to such a position that rods 39 lie at the lowest point of inclined slots 37 (the position illustrated in FIG. 1) and the device, having at least one elongated contact, has such contact or contacts inserted through one or more of contact receptacles 11. With rods 39 in their low positions, a relatively large gap exists between the semicircular portion of spring contacts 29 and contact board 47, shown most vividly in FIG. 2. The gap, coupled with the loosely designed fitting of contact receptacles 11, allows the insertion of an elongated contact encountering little, if any opposing force. In complex and miniaturized arrays, such contacts may be of slight transverse dimension as a packaging consideration and subject to harm from relatively minor insertion forces.

After the insertion of the elongated contacts of the device, the operator may complete the electrical connection of the first device with the electrical device in contact with one or more of the pins 16 by moving the cam activator 27 to such position that rods 39 sit at the top of the inclines formed in inclined slots 37. This shift of the cam activator 27 causes simultaneous and identical vertical movements of rods 39. FIG. 2 illustrates the inclined recesses 45 of split camming block 42 and the seating of the spring contacts 29 therein. In FIG. 3 it is seen that rods 39 are located internally in cam block 42 and sit in a vertical slot 63 which exists in connector side panels 21. Lower contact spring 65 completes electrical contact between console contact pins 61 and plane contacts 49 and exerts a retaining force on contact board 47. Thus, vertical movement of rods 39, causing an upward movement of cam block 42, will cause the spring contacts 29 of contact board 47 toward one another. This is due to the inclined internal surface of the cam block 42 against which the spring contacts 29 are seated. The pinching movement caused thereby brings the spring contacts 29 into electrical connection with the elongated contact of the first device protruding through contact receptacle 11. This completes the electrical connection of the device joined to contact pins 61 with that joined to contact receptacles 11. If the first device does not posses elongated contacts, obvious adaptations of the present invention, such as removal of interface 13 may be made in accord with the present invention.

Due to the loose fit of the elongated contacts in the receptacles 11 and the relatively large gap existing between spring contacts 29 and contact board 47 before rods 39 achieve their upper position, no force is exerted upon the elongated contacts until they are in place and fully aligned. Also, due to the unique construction of the invention and particularly the split nature of camming block 42, the contact board 47 may be replaced independent of other parts of the invention by a simple disassembly seen clearly in FIG. 4. This is a particularly useful feature of the invention when utilized as an interface for an electrical test console. The continual insertion and removal of the devices to be tested degrades the spring contacts 29 more severely than another portion of the invention. Simple replacement or repair of the contact board 47 will assure long term performance of the invention.

Thus there is provided a durable no-force connector in which an electrical device may be plugged into the invention causing minimal device degradation and allowing easy replacement of degradable parts for long-term efficiency of operation.

What is claimed is:

1. An electrical connector which comprises:

a. an upper portion for receiving at least one contact from a first electrical device;

b. a lower portion for receiving at least one contact from a second electrical device;

c. a contact board located between said upper and lower portions, said board having at least one electrical contact thereon, said at least one electrical contact comprising a strip portion joined to a spring portion, said strip portion consisting of electrically conductive material located on the face of the board and said spring portion, in contact with said strip portion, consisting of resilient electrically conducting material attached to said board at one end and projecting therefrom at the other end;

d. a camming apparatus located in said upper portion;

e. said camming apparatus comprises a matched pair of blocks surrounding said contact board;

f. each block having a top portion and a bottom portion and each having at least one cavity in its inward-facing side;

g. said at least one cavity is larger at said top portion than at said bottom portion; whereby h. an electrical connection may be made between said first and second devices said connection being completed and undone according to the positioning of said contact board within said camming apparatus.

2. An electrical connector as described in claim 1 wherein said electrical connector further comprises:

a. said camming apparatus has a pair of sides each side having parallel inclined slots and each side located in a notch in said upper portion of said electrical connector;

b. a pair of end pieces joined to said sides to maintain a parallel spaced positioning therebetween;

c. a pair of rods projecting through said matched pair of blocks and seated in said inclined slots and in a vertical slot in said upper portion of said electrical connector of vertical dimension at least as great as the vertical displacement of said inclined slot so that when said pair of sides of said camming apparatus are shifted in position within said joint in said upper portion of said electrical connector, said rods are caused to be displaced in a vertical direction thereby causing said matched pair of blocks to undergo vertical movement.

3. An electrical connector as described in claim 2 wherein said connector additionally comprises:

a. a pair of shoulders which join said top portion to said bottom portion; and b. each of said shoulders has a pair of notches to accommodate the sides of said camming apparatus.

4. An electrical connector as described in claim 3 which additionally comprises:

a. attachment means to join the lower portion of said electrical connector to a surface located at the bottom of each of said shoulders;

b. said means being removable, so that, upon removal of said attachment means and said rods said electrical connector is sufficiently disassembled to allow manual removal of said contact board.

5. An electrical connector as described in claim 4 wherein said upper portion has at least one opening to admit an elongated electrical contact from said first electrical device.

6. An electrical connector as described in claim 5 wherein said opening in said upper portion is of funnel shape.

7. An electrical connector as described in claim 6 wherein:

a. said contact spring portion further has a straight lower portion adapted to the shape of said at least one cavity of said camming block; and b. an upper portion having a bend toward said contact board.

* * * * *